US009284855B2

(12) United States Patent
Held et al.

(10) Patent No.: US 9,284,855 B2
(45) Date of Patent: Mar. 15, 2016

(54) PARALLEL CYCLE HEAT ENGINES

(75) Inventors: Timothy James Held, Akron, OH (US); Michael Louis Vermeersch, Hamiliton, OH (US); Tao Xie, Copley, OH (US); Jason Miller, Hudson, OH (US)

(73) Assignee: Echogen Power Systems, LLC, Akron, OH (US)

( * ) Notice: Subject to any disclaimer, the term of this patent is extended or adjusted under 35 U.S.C. 154(b) by 332 days.

(21) Appl. No.: 13/212,631

(22) Filed: Aug. 18, 2011

(65) Prior Publication Data

US 2012/0131920 A1 May 31, 2012

Related U.S. Application Data

(60) Provisional application No. 61/417,789, filed on Nov. 29, 2010.

(51) Int. Cl.

| | |
|---|---|
| ***F02C 1/04*** | (2006.01) |
| ***F01K 25/08*** | (2006.01) |
| ***F01K 3/22*** | (2006.01) |
| ***F01K 3/18*** | (2006.01) |
| ***F01K 13/02*** | (2006.01) |
| ***F01K 25/10*** | (2006.01) |
| ***F01K 23/04*** | (2006.01) |
| ***F22B 35/08*** | (2006.01) |

(52) U.S. Cl.

CPC ..... *F01K 13/02* (2013.01); *F01K 23/04* (2013.01); *F01K 25/10* (2013.01); *F01K 25/103* (2013.01); *F22B 35/086* (2013.01)

(58) Field of Classification Search

CPC ..... F01K 13/02; F01K 23/04; F01K 25/01; F01K 25/103; F22B 35/086

USPC ..... 60/650, 641.7, 673, 649

See application file for complete search history.

(56) References Cited

U.S. PATENT DOCUMENTS 3,630,022 A 12/1971 Jubb
3,830,062 A 8/1974 Morgan et al.

(Continued)

FOREIGN PATENT DOCUMENTS

CN 1165238 A 11/1997
CN 1432102 A 7/2003

(Continued)

OTHER PUBLICATIONS

Power Cycles With Ammonia-Water Mixtures As Working Fluid, Doctoral Thesis, Eva Thorin 2000, Department of Chemical Engineering and Technology Energy Process, Royal Institute of Technology, Stockholm, Sweden.*

(Continued)

*Primary Examiner* — Jorge Pereiro
*Assistant Examiner* — Deming Wan
(74) *Attorney, Agent, or Firm* — Edmonds & Nolte, PC

(57) ABSTRACT

Waste heat energy conversion cycles, systems and devices use multiple waste heat exchangers arranged in series in a waste heat stream, and multiple thermodynamic cycles run in parallel with the waste heat exchangers in order to maximize thermal energy extraction from the waste heat stream by a working fluid. The parallel cycles operate in different temperature ranges with a lower temperature work output used to drive a working fluid pump. A working fluid mass management system is integrated into or connected to the cycles.

26 Claims, 8 Drawing Sheets

(56) References Cited

U.S. PATENT DOCUMENTS

| | | | | |
|---|---|---|---|---|
| 4,150,547 | A | 4/1979 | Hobson | |
| 4,164,849 | A * | 8/1979 | Mangus | 60/679 |
| 4,170,435 | A | 10/1979 | Swearingen | |
| 4,236,869 | A | 12/1980 | Laurello | |
| 4,538,960 | A | 9/1985 | Iino et al. | |
| 4,549,401 | A | 10/1985 | Spliethoff | |
| 4,573,321 | A * | 3/1986 | Knaebel | 60/649 |
| 4,697,981 | A | 10/1987 | Brown et al. | |
| 4,730,977 | A | 3/1988 | Haaser | |
| 4,756,162 | A * | 7/1988 | Dayan | 60/673 |
| 4,765,143 | A | 8/1988 | Crawford | |
| 4,867,633 | A | 9/1989 | Gravelle | |
| 4,892,459 | A | 1/1990 | Guelich | |
| 5,083,425 | A | 1/1992 | Hendriks et al. | |
| 5,102,295 | A | 4/1992 | Pope | |
| 5,104,284 | A | 4/1992 | Hustak, Jr. | |
| 5,320,482 | A | 6/1994 | Palmer et al. | |
| 5,358,378 | A | 10/1994 | Holscher | |
| 5,440,882 | A * | 8/1995 | Kalina | 60/641.2 |
| 5,588,298 | A * | 12/1996 | Kalina et al. | 60/676 |
| 5,605,118 | A * | 2/1997 | Sinn et al. | 122/479.1 |
| 5,634,340 | A | 6/1997 | Grennan | |
| 5,754,613 | A | 5/1998 | Hashiguchi | |
| 5,813,215 | A | 9/1998 | Weisser | |
| 5,862,666 | A | 1/1999 | Liu | |
| 6,065,280 | A * | 5/2000 | Ranasinghe et al. | 60/774 |
| 6,129,507 | A | 10/2000 | Ganelin | |
| 6,581,384 | B1 | 6/2003 | Benson | |
| 6,735,948 | B1 * | 5/2004 | Kalina | 60/649 |
| 6,751,959 | B1 | 6/2004 | McClanahan | |
| 6,941,757 | B2 * | 9/2005 | Kalina | 60/649 |
| 7,096,665 | B2 | 8/2006 | Stinger | |
| 7,096,679 | B2 | 8/2006 | Manole | |
| 7,305,829 | B2 * | 12/2007 | Mirolli et al. | 60/649 |
| 7,406,830 | B2 | 8/2008 | Valentian | |
| 7,464,551 | B2 | 12/2008 | Althaus et al. | |
| 7,600,394 | B2 * | 10/2009 | Kalina | 62/606 |
| 7,665,291 | B2 * | 2/2010 | Anand et al. | 60/39.12 |
| 7,685,821 | B2 * | 3/2010 | Kalina | 60/649 |
| 7,770,376 | B1 * | 8/2010 | Brostmeyer | 60/39.182 |
| 7,775,758 | B2 | 8/2010 | Legare | |
| 7,997,076 | B2 | 8/2011 | Ernst | |
| 8,419,936 | B2 | 4/2013 | Berger et al. | |
| 2001/0020444 | A1 | 9/2001 | Johnston | |
| 2003/0154718 | A1 * | 8/2003 | Nayar | 60/649 |
| 2003/0167769 | A1 * | 9/2003 | Bharathan et al. | 60/676 |
| 2004/0088992 | A1 | 5/2004 | Brasz et al. | |
| 2005/0022963 | A1 | 2/2005 | Garrabrant et al. | |
| 2005/0056001 | A1 | 3/2005 | Frutschi | |
| 2006/0010868 | A1 | 1/2006 | Smith | |
| 2006/0080960 | A1 * | 4/2006 | Rajendran et al. | 60/649 |
| 2006/0225421 | A1 | 10/2006 | Yamanaka et al. | |
| 2007/0017192 | A1 | 1/2007 | Bednarek et al. | |
| 2007/0234722 | A1 * | 10/2007 | Kalina | 60/645 |
| 2008/0000225 | A1 * | 1/2008 | Kalina | 60/517 |
| 2008/0010967 | A1 | 1/2008 | Griffin | |
| 2008/0053095 | A1 | 3/2008 | Kalina | |
| 2008/0135253 | A1 * | 6/2008 | Vinegar et al. | 166/302 |
| 2008/0163625 | A1 | 7/2008 | O'Brien | |
| 2009/0211253 | A1 | 8/2009 | Radcliff et al. | |
| 2009/0293503 | A1 * | 12/2009 | Vandor | 62/45.1 |
| 2010/0102008 | A1 | 4/2010 | Hedberg | |
| 2010/0122533 | A1 * | 5/2010 | Kalina | 60/645 |
| 2010/0287920 | A1 * | 11/2010 | Duparchy | 60/320 |
| 2010/0287934 | A1 | 11/2010 | Glynn et al. | |
| 2011/0027064 | A1 | 2/2011 | Pal et al. | |
| 2011/0179799 | A1 | 7/2011 | Allam | |
| 2011/0203278 | A1 | 8/2011 | Kopecek et al. | |
| 2011/0259010 | A1 | 10/2011 | Bronicki et al. | |
| 2011/0299972 | A1 | 12/2011 | Morris | |
| 2011/0308253 | A1 | 12/2011 | Ritter | |
| 2012/0131921 | A1 | 5/2012 | Held | |
| 2012/0261090 | A1 | 10/2012 | Durmaz et al. | |
| 2013/0019597 | A1 | 1/2013 | Kalina | |

FOREIGN PATENT DOCUMENTS

| | | | |
|---|---|---|---|
| CN | 101614139 | A | 12/2009 |
| DE | 2632777 | A1 | 2/1977 |
| DE | 10052993 | A1 | 5/2002 |
| EP | 1998013 | A2 | 12/2008 |
| GB | 2010974 | A | 7/1979 |
| JP | 60040707 | A | 3/1985 |
| JP | 61-152914 | A | 7/1986 |
| JP | 01-240705 | A | 9/1989 |
| JP | 08028805 | A | 2/1996 |
| JP | H11270352 | | 5/1999 |
| JP | 2000257407 | A | 9/2000 |
| JP | 2003529715 | A | 10/2003 |
| JP | 2005030727 | A | 2/2005 |
| JP | 2005-533972 | | 11/2005 |
| JP | 2006037760 | A | 2/2006 |
| JP | 2006177266 | A | 7/2006 |
| JP | 2007-198200 | | 8/2007 |
| KR | 10-0191080 | B1 | 6/1999 |
| KR | 10-0844634 | B1 | 7/2008 |
| WO | 0071944 | A1 | 11/2000 |
| WO | 2008101711 | A2 | 8/2008 |
| WO | 2009-045196 | A1 | 4/2009 |
| WO | 2010-074173 | A1 | 7/2010 |
| WO | 2010083198 | A1 | 7/2010 |
| WO | 2012074905 | A2 | 6/2012 |
| WO | 2012074907 | A2 | 6/2012 |
| WO | 2012074911 | A2 | 6/2012 |

OTHER PUBLICATIONS

The New Generation Kalian Cycle, Dr. Manfred Renz, Electricity Generation from Enhanced Geothermal Systems, Sep. 2006.*

PCT/US2011/029486—International Search Report and Written Opinion dated Nov. 16, 2011.

PCT/US2011/062201—International Search Report and Written Opinion dated Jun. 26, 2012.

PCT/US2011/062207—International Search Report and Written Opinion dated Jun. 28, 2012.

PCT/US2011/062198—International Search Report and Written Opinion dated Jul. 2, 2012.

PCT/US2011/062266—International Search Report and Written Opinion dated Jul. 9, 2012.

PCT/US2011/029486—International Preliminary Report on Patentability dated Sep. 25, 2012.

PCT/US2011/062204—International Search Report and Written Opinion dated Nov. 1, 2012.

Vaclav Dostal, Martin Kulhanek, "Research on the Supercritical Carbon Dioxide Cycles in the Czech Republic", Department of Fluid Mechanics and Power Engineering Czech Technical University in Prague, RPI, Troy, NY, Apr. 29-30, 2009; 8 pages.

CN Search Report for Application No. 201080035382.1, 2 pages.

CN Search Report for Application No. 201080050795.7, 2 pages.

PCT/US2011/062198—Extended European Search Report dated May 6, 2014, 9 pages.

PCT/US2011/055547—Extended European Search Report dated May 28, 2014, 8 pages.

PCT/US2013/055547—Notification of Transmittal of the International Search Report and the Written Opinion of the International Searching Authority, or the Declaration dated Jan. 24, 2014, 11 pages.

PCT/US2013/064470—Notification of Transmittal of the International Search Report and the Written Opinion of the International Searching Authority, or the Declaration dated Jan. 22, 2014, 10 pages.

PCT/US2013/064471—Notification of Transmittal of the International Search Report and the Written Opinion of the International Searching Authority, or the Declaration dated Jan. 24, 2014, 10 pages.

PCT/US2014/013154—International Search Report dated May 23, 2014, 4 pages.

(56) References Cited

OTHER PUBLICATIONS

PCT/US2014/013170—Notification of Transmittal of the International Search Report and the Written Opinion of the International Searching Authority, or the Declaration dated May 9, 2014, 12 pages.
PCT/US2014/023026—Notification of Transmittal of the International Search Report and the Written Opinion of the International Searching Authority, or the Declaration dated Jul. 22, 2014, 11 pages.
PCT/US2014/023990—Notification of Transmittal of the International Search Report and the Written Opinion of the International Searching Authority, or the Declaration dated Jul. 17, 2014, 10 pages.
PCT/US2014/026173—Notification of Transmittal of the International Search Report and the Written Opinion of the International Searching Authority, or the Declaration dated Jul. 9, 2014, 10 pages.
Renz, Manfred, "The New Generation Kalina Cycle", Contribution to the Conference: "Electricity Generation from Enhanced Geothermal Systems", Sep. 14, 2006, Strasbourg, France, 18 pages.
Thorin, Eva, "Power Cycles with Ammonia-Water Mixtures as Working Fluid", Doctoral Thesis, Department of Chemical Engineering and Technology Energy Processes, Royal Institute of Technology, Stockholm, Sweden, 2000, 66 pages.

* cited by examiner

PARALLEL CYCLE HEAT ENGINES

CROSS-REFERENCE TO RELATED APPLICATIONS

This application claims priority to U.S. Provisional Patent Application Ser. No. 61/417,789, filed Nov. 29, 2010, the contents of which are hereby incorporated by reference in their entirety into the present application.

BACKGROUND

Heat is often created as a byproduct of industrial processes where flowing streams of liquids, solids, or gasses that contain heat must be exhausted into the environment or otherwise removed from the process in an effort to maintain the operating temperatures of the industrial process equipment. Sometimes the industrial process can use heat exchanging devices to capture the heat and recycle it back into the process via other process streams. Other times it is not feasible to capture and recycle this heat because it is either too low in temperature or there is no readily available means to use as heat directly. This type of heat is generally referred to as "waste" heat, and is typically discharged directly into the environment through, for example, a stack, or indirectly through a cooling medium, such as water. In other settings, such heat is readily available from renewable sources of thermal energy, such as heat from the sun (which may be concentrated or otherwise manipulated) or geothermal sources. These and other thermal energy sources are intended to fall within the definition of "waste heat," as that term is used herein.

Waste heat can be utilized by turbine generator systems which employ thermodynamic methods, such as the Rankine cycle, to convert heat into work. Typically, this method is steam-based, wherein the waste heat is used to raise steam in a boiler to drive a turbine. However, at least one of the key short-comings of a steam-based Rankine cycle is its high temperature requirement, which is not always practical since it generally requires a relatively high temperature (600° F. or higher, for example) waste heat stream or a very large overall heat content. Also, the complexity of boiling water at multiple pressures/temperatures to capture heat at multiple temperature levels as the heat source stream is cooled is costly in both equipment cost and operating labor. Furthermore, the steam-based Rankine cycle is not a realistic option for streams of small flow rate and/or low temperature.

The organic Rankine cycle (ORC) addresses the short-comings of the steam-based Rankine cycles by replacing water with a lower boiling-point fluid, such as a light hydrocarbon like propane or butane, or a HCFC (e.g., R245fa) fluid. However, the boiling heat transfer restrictions remain, and new issues such as thermal instability, toxicity or flammability of the fluid are added.

To address these short-comings, supercritical $CO_2$ power cycles have been used. The supercritical state of the $CO_2$ provides improved thermal coupling with multiple heat sources. For example, by using a supercritical fluid, the temperature glide of a process heat exchanger can be more readily matched. However, single cycle supercritical $CO_2$ power cycles operate over a limited pressure ratio, thereby limiting the amount of temperature reduction, i.e., energy extraction, through the power conversion device (typically a turbine or positive displacement expander). The pressure ratio is limited primarily due to the high vapor pressure of the fluid at typically available condensation temperatures (e.g., ambient). As a result, the maximum output power that can be achieved from a single expansion stage is limited, and the expanded fluid retains a significant amount of potentially usable energy. While a portion of this residual energy can be recovered within the cycle by using a heat exchanger as a recuperator, and thus pre-heating the fluid between the pump and waste heat exchanger, this approach limits the amount of heat that can be extracted from the waste heat source in a single cycle.

Accordingly, there exists a need in the art for a system that can efficiently and effectively produce power from not only waste heat, but also from a wide range of thermal sources.

SUMMARY

Embodiments of the disclosure may provide a system for converting thermal energy to work. The system may include a pump configured to circulate a working fluid throughout a working fluid circuit, the working fluid being separated into a first mass flow and a second mass flow downstream from the pump, and a first heat exchanger fluidly coupled to the pump and in thermal communication with a heat source, the first heat exchanger being configured to receive the first mass flow and transfer heat from the heat source to the first mass flow. The system may also include a first turbine fluidly coupled to the first heat exchanger and configured to expand the first mass flow, and a first recuperator fluidly coupled to the first turbine and configured to transfer residual thermal energy from the first mass flow discharged from the first turbine to the first mass flow directed to the first heat exchanger. The system may further include a second heat exchanger fluidly coupled to the pump and in thermal communication with the heat source, the second heat exchanger being configured to receive the second mass flow and transfer heat from the heat source to the second mass flow, and a second turbine fluidly coupled to the second heat exchanger and configured to expand the second mass flow.

Embodiments of the disclosure may further provide another system for converting thermal energy to work. The additional system may include a pump configured to circulate a working fluid throughout a working fluid circuit, the working fluid being separated into a first mass flow and a second mass flow downstream from the pump, a first heat exchanger fluidly coupled to the pump and in thermal communication with a heat source, the first heat exchanger being configured to receive the first mass flow and transfer heat from the heat source to the first mass flow, and a first turbine fluidly coupled to the first heat exchanger and configured to expand the first mass flow. The system may also include a first recuperator fluidly coupled to the first turbine and configured to transfer residual thermal energy from the first mass flow discharged from the first turbine to the first mass flow directed to the first heat exchanger, a second heat exchanger fluidly coupled to the pump and in thermal communication with the heat source, the second heat exchanger being configured to receive the second mass flow and transfer heat from the heat source to the second mass flow, and a second turbine fluidly coupled to the second heat exchanger and configured to expand the second mass flow, the second mass flow being discharged from the second turbine and re-combined with the first mass flow to generate a combined mass flow. The system may further include a second recuperator fluidly coupled to the second turbine and configured to transfer residual thermal energy from the combined mass flow to the second mass flow directed to the second heat exchanger, and a third heat exchanger in thermal communication with the heat source and arranged between the pump and the first heat exchanger, the third heat exchanger being configured to receive and transfer heat to the first mass flow prior to passing through the first heat exchanger Embodiments of the disclosure may further provide a method for converting thermal energy to work. The method may include circulating a working fluid with a pump throughout a working fluid circuit, separating the working fluid in the working fluid circuit into a first mass flow and a second mass flow, and transferring thermal energy in a first heat exchanger from a heat source to the first mass flow, the first heat exchanger being in thermal communication with the heat source. The method may also include expanding the first mass flow in a first turbine fluidly coupled to the first heat exchanger, transferring residual thermal energy in a first recuperator from the first mass flow discharged from the first turbine to the first mass flow directed to the first heat exchanger, the first recuperator being fluidly coupled to the first turbine, and transferring thermal energy in a second heat exchanger from the heat source to the second mass flow, the second heat exchanger being in thermal communication with the heat source. The method may further include expanding the second mass flow in a second turbine fluidly coupled to the second heat exchanger.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
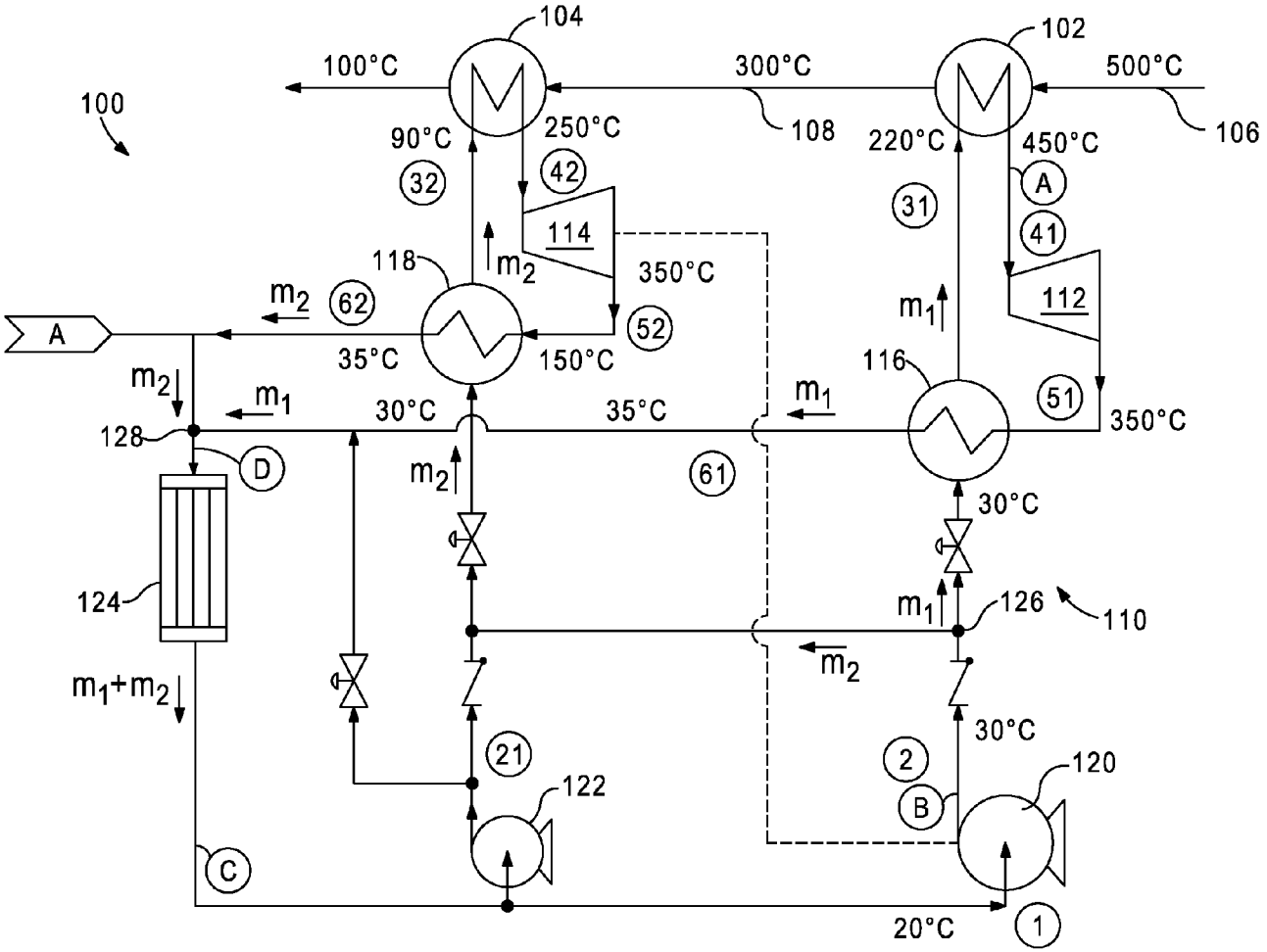
FIG. 1 schematically illustrates an exemplary embodiment of a parallel heat engine cycle, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates an exemplary thermodynamic cycle 100, according to one or more embodiments of the disclosure that may be used to convert thermal energy to work by thermal expansion of a working fluid. The cycle 100 is characterized as a Rankine cycle and may be implemented in a heat engine device that includes multiple heat exchangers in fluid communication with a waste heat source, multiple turbines for power generation and/or pump driving power, and multiple recuperators located downstream of the turbine(s).

Specifically, the thermodynamic cycle 100 may include a working fluid circuit 110 in thermal communication with a heat source 106 via a first heat exchanger 102, and a second heat exchanger 104 arranged in series. It will be appreciated that any number of heat exchangers may be utilized in conjunction with one or more heat sources. In one exemplary embodiment, the first and second heat exchangers 102, 104 may be waste heat exchangers. In other exemplary embodiments, the first and second heat exchangers 102, 104 may include first and second stages, respectively, of a single or combined waste heat exchanger.

The heat source 106 may derive thermal energy from a variety of high temperature sources. For example, the heat source 106 may be a waste heat stream such as, but not limited to, gas turbine exhaust, process stream exhaust, or other combustion product exhaust streams, such as furnace or boiler exhaust streams. Accordingly, the thermodynamic cycle 100 may be configured to transform waste heat into electricity for applications ranging from bottom cycling in gas turbines, stationary diesel engine gensets, industrial waste heat recovery (e.g., in refineries and compression stations), and hybrid alternatives to the internal combustion engine. In other exemplary embodiments, the heat source 106 may derive thermal energy from renewable sources of thermal energy such as, but not limited to, solar thermal and geothermal sources.

While the heat source 106 may be a fluid stream of the high temperature source itself, in other exemplary embodiments the heat source 106 may be a thermal fluid in contact with the high temperature source. The thermal fluid may deliver the thermal energy to the waste heat exchangers 102, 104 to transfer the energy to the working fluid in the circuit 100.

As illustrated, the first heat exchanger 102 may serve as a high temperature, or relatively higher temperature, heat exchanger adapted to receive an initial or primary flow of the heat source 106. In various exemplary embodiments of the disclosure, the initial temperature of the heat source 106 entering the cycle 100 may range from about 400° F. to greater than about 1,200° F. (about 204° C. to greater than about 650° C.). In the illustrated exemplary embodiment, the initial flow of the heat source 106 may have a temperature of about 500° C. or higher. The second heat exchanger 104 may then receive the heat source 106 via a serial connection 108 downstream from the first heat exchanger 102. In one exemplary embodiment, the temperature of the heat source 106 provided to the second heat exchanger 104 may be about 250-300° C. It should be noted that representative operative temperatures, pressures, and flow rates as indicated in the Figures are by way of example and are not in any way to be considered as limiting the scope of the disclosure.

As can be appreciated, a greater amount of thermal energy is transferred from the heat source 106 via the serial arrangement of the first and second heat exchangers 102, 104, whereby the first heat exchanger 102 transfers heat at a relatively higher temperature spectrum in the waste heat stream 106 than the second heat exchanger 104. Consequently, greater power generation results from the associated turbines or expansion devices, as will be described in more detail below.

The working fluid circulated in the working fluid circuit 110, and the other exemplary circuits disclosed herein below, may be carbon dioxide ($CO_2$). Carbon dioxide as a working fluid for power generating cycles has many advantages. It is a greenhouse friendly and neutral working fluid that offers benefits such as non-toxicity, non-flammability, easy availability, low price, and no need of recycling. Due in part to its relative high working pressure, a $CO_2$ system can be built that is much more compact than systems using other working fluids. The high density and volumetric heat capacity of $CO_2$ with respect to other working fluids makes it more "energy dense" meaning that the size of all system components can be considerably reduced without losing performance. It should be noted that the use of the term "carbon dioxide" as used herein is not intended to be limited to a $CO_2$ of any particular type, purity, or grade. For example, in at least one exemplary embodiment industrial grade $CO_2$ may be used, without departing from the scope of the disclosure.

In other exemplary embodiments, the working fluid in the circuit 110 may be a binary, ternary, or other working fluid blend. The working fluid blend or combination can be selected for the unique attributes possessed by the fluid combination within a heat recovery system, as described herein. For example, one such fluid combination includes a liquid absorbent and $CO_2$ mixture enabling the combined fluid to be pumped in a liquid state to high pressure with less energy input than required to compress $CO_2$. In another exemplary embodiment, the working fluid may be a combination of $CO_2$ or supercritical carbon dioxide ($ScCO_2$) and one or more other miscible fluids or chemical compounds. In yet other exemplary embodiments, the working fluid may be a combination of $CO_2$ and propane, or $CO_2$ and ammonia, without departing from the scope of the disclosure.

Use of the term "working fluid" is not intended to limit the state or phase of matter that the working fluid is in. In other words, the working fluid may be in a fluid phase, a gas phase, a supercritical phase, a subcritical state, or any other phase or state at any one or more points within the fluid cycle. The working fluid may be in a supercritical state over certain portions of the circuit 110 (the "high pressure side"), and in a subcritical state over other portions of the circuit 110 (the "low pressure side"). In other exemplary embodiments, the entire working fluid circuit 110 may be operated and controlled such that the working fluid is in a supercritical or subcritical state during the entire execution of the circuit 110.

The heat exchangers 102, 104 are arranged in series in the heat source 106, but arranged in parallel in the working fluid circuit 110. The first heat exchanger 102 may be fluidly coupled to a first turbine 112, and the second heat exchanger 104 may be fluidly coupled to a second turbine 114. In turn, the first turbine 112 may be fluidly coupled to a first recuperator 116, and the second turbine 114 may be fluidly coupled to a second recuperator 118. One or both of the turbines 112, 114 may be a power turbine configured to provide electrical power to auxiliary systems or processes. The recuperators 116, 118 may be arranged in series on a low temperature side of the circuit 110 and in parallel on a high temperature side of the circuit 110. The recuperators 116, 118 divide the circuit 110 into the high and low temperature sides. For example, the high temperature side of the circuit 110 includes the portions of the circuit 110 arranged downstream from each recuperator 116, 118 where the working fluid is directed to the heat exchangers 102, 104. The low temperature side of the circuit 110 includes the portions of the circuit downstream from each recuperator 116, 118 where the working fluid is directed away from the heat exchangers 102, 104.

The working fluid circuit 110 may further include a first pump 120 and a second pump 122 in fluid communication with the components of the fluid circuit 110 and configured to circulate the working fluid. The first and second pumps 120, 122 may be turbopumps, or driven independently by one or more external machines or devices, such as a motor. In one exemplary embodiment, the first pump 120 may be used to circulate the working fluid during normal operation of the cycle 100 while the second pump 122 may be nominally driven and used only for starting the cycle 100. In at least one exemplary embodiment, the second turbine 114 may be used to drive the first pump 120, but in other exemplary embodiments the first turbine 112 may be used to drive the first pump 120, or the first pump 120 may be nominally driven by a motor (not shown).

The first turbine 112 may operate at a higher relative temperature (e.g., higher turbine inlet temperature) than the second turbine 114, due to the temperature drop of the heat source 106 experienced across the first heat exchanger 102. In one or more exemplary embodiments, however, each turbine 112, 114 may be configured to operate at the same or substantially the same inlet pressure. This may be accomplished by design and control of the circuit 110 including, but not limited to, the control of the first and second pumps 120, 122 and/or the use of multiple-stage pumps to optimize the inlet pressures of each turbine 112, 114 for corresponding inlet temperatures of the circuit 110.

In one or more exemplary embodiments, the inlet pressure at the first pump 120 may exceed the vapor pressure of the working fluid by a margin sufficient to prevent vaporization of the working fluid at the local regions of the low pressure and/or high velocity. This is especially important with high speed pumps, such as the turbopumps that may be used in the various exemplary embodiments disclosed herein. Consequently, a traditional passive pressurization system, such as one that employs a surge tank which only provides the incremental pressure of gravity relative to the fluid vapor pressure, may prove insufficient for the exemplary embodiments disclosed herein.

The working fluid circuit 110 may further include a condenser 124 in fluid communication with one or both the first and second recuperators 116, 118. The low-pressure discharge working fluid flow exiting each recuperator 116, 118 may be directed through the condenser 124 to be cooled for return to the low temperature side of the circuit 110 and to either the first or second pump 120, 122.

In operation, the working fluid is separated at point 126 in the working fluid circuit 110 into a first mass flow $m_1$ and a second mass flow $m_2$. The first mass flow $m_1$ is directed through the first heat exchanger 102 and subsequently expanded in the first turbine 112. Following the first turbine 112, the first mass flow $m_1$ passes through the first recuperator 116 in order to transfer residual heat back to the first mass flow $m_1$ as it is directed toward the first heat exchanger 102. The second mass flow $m_2$ may be directed through the second heat exchanger 104 and subsequently expanded in the second turbine 114. Following the second turbine 114, the second mass flow $m_2$ passes through the second recuperator 118 to transfer residual heat back to the second mass flow $m_2$ as it is directed towed the second heat exchanger 104. The second mass flow $m_2$ is then re-combined with the first mass flow $m_1$ at point 128 in the working fluid circuit 110 to generate a combined mass flow $m_1+m_2$. The combined mass flow $m_1+m_2$ may be directed through the condenser 124 and back to the pump 120 to commence the loop over again. In at least one embodiment, the working fluid at the inlet of the pump 120 is supercritical.

As can be appreciated, each stage of heat exchange with the heat source 106 can be incorporated in the working fluid circuit 110 where it is most effectively utilized within the complete thermodynamic cycle 100. For example, by splitting the heat exchange into multiple stages, either with separate heat exchangers (e.g., first and second heat exchangers 102, 104) or a single or multiple heat exchangers with multiple stages, additional heat can be extracted from the heat source 106 for more efficient use in expansion, and primarily to obtain multiple expansions from the heat source 106.

Also, by using multiple turbines 112, 114 at similar or substantially similar pressure ratios, a larger fraction of the available heat source 106 may be efficiently utilized by using the residual heat from each turbine 112, 114 via the recuperators 116, 118 such that the residual heat is not lost or compromised. The arrangement of the recuperators 116, 118 in the working fluid circuit 110 can be optimized with the heat source 106 to maximize power output of the multiple temperature expansions in the turbines 112, 114. By selectively merging the parallel working fluid flows, the two sides of either of the recuperators 116, 118 may be balanced, for example, by matching heat capacity rates; $C=m\cdot c_p$, where C is the heat capacity rate, m is the mass flow rate of the working fluid, and $c_p$ is the constant pressure specific heat.

Figure 2:
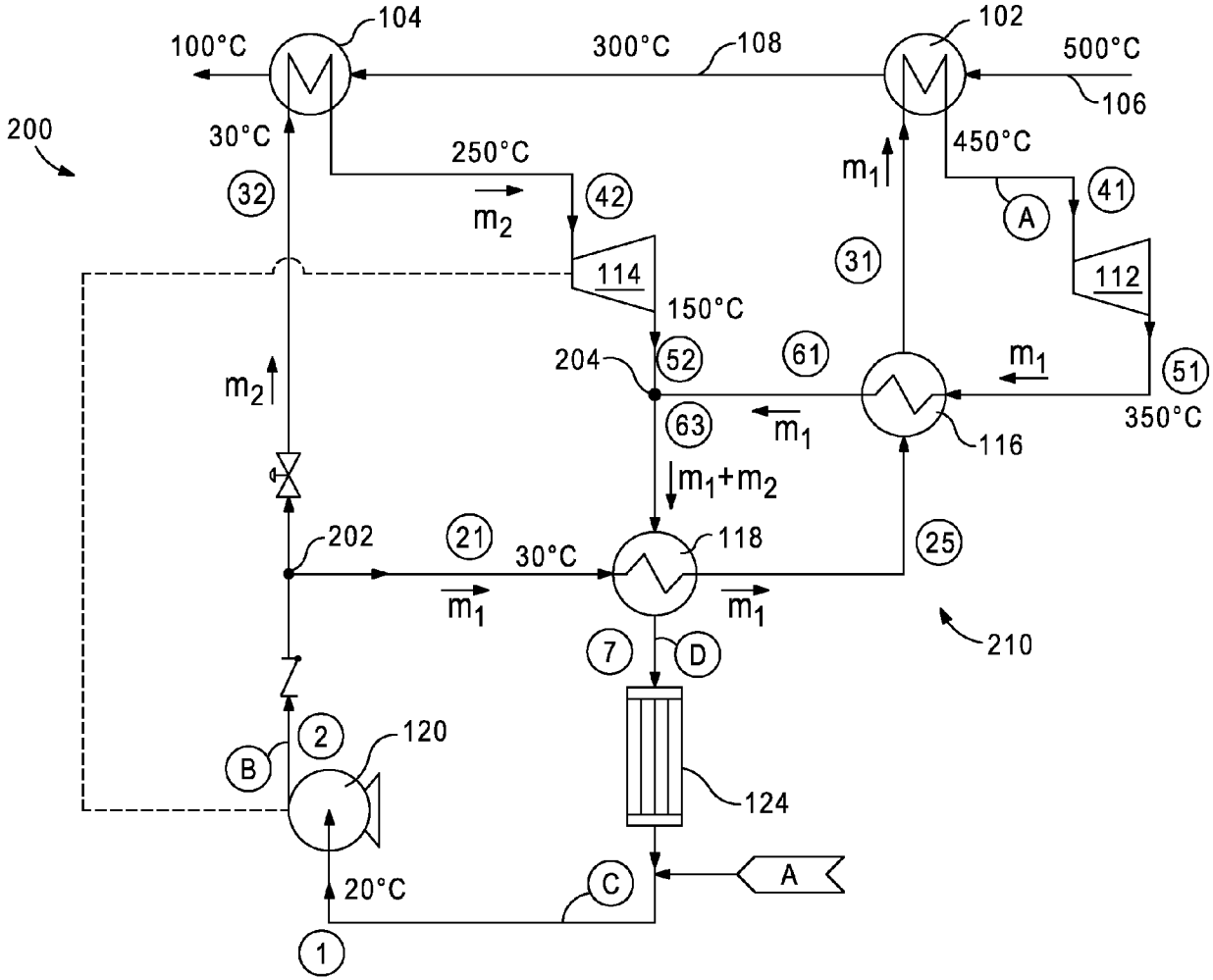
FIG. 2 schematically illustrates another exemplary embodiment of a parallel heat engine cycle, according to one or more embodiments disclosed.

FIG. 2 illustrates another exemplary embodiment of a thermodynamic cycle 200, according to one or more embodiments disclosed, The cycle 200 may be similar in some respects to the thermodynamic cycle 100 described above with reference to FIG. 1. Accordingly, the thermodynamic cycle 200 may be best understood with reference to FIG. 1, where like numerals correspond to like elements and therefore will not be described again in detail. The cycle 200 includes first and second heat exchangers 102, 104 again arranged in series in thermal communication with the heat source 106, but in parallel in a working fluid circuit 210. The first and second recuperators 116 and 118 are arranged in series on the low temperature side of the circuit 210 and in parallel on the high temperature side of the circuit 210.

In the circuit 210, the working fluid is separated into a first mass flow $m_1$ and a second mass flow $m_2$ at a point 202. The first mass flow $m_1$ is eventually directed through the first heat exchanger 102 and subsequently expanded in the first turbine 112. The first mass flow $m_1$ then passes through the first recuperator 116 to transfer residual heat back to the first mass flow $m_1$ coursing past state 25 and into the first recuperator 116. The second mass flow $m_2$ may be directed through the second heat exchanger 104 and subsequently expanded in the second turbine 114. Following the second turbine 114, the second mass flow $m_2$ is re-combined with the first mass flow $m_1$ at point 204 to generate a combined mass flow $m_1+m_2$. The combined mass flow $m_1+m_2$ may be directed through the second recuperator 118 to transfer residual heat to the first mass flow $m_1$ passing through the second recuperator 118.

The arrangement of the recuperators 116, 118 provides the combined mass flow $m_1+m_2$ to the second recuperator 118 prior to reaching the condenser 124. As can be appreciated, this may increase the thermal efficiency of the working fluid circuit 210 by providing better matching of the heat capacity rates, as defined above.

As illustrated, the second turbine 114 may be used to drive the first or main working fluid pump 120. In other exemplary embodiments, however, the first turbine 112 may be used to drive the pump 120, without departing from the scope of the disclosure. As will be discussed in more detail below, the first and second turbines 112, 114 may be operated at common turbine inlet pressures or different turbine inlet pressures by management of the respective mass flow rates at the corresponding states 41 and 42.

Figure 3:
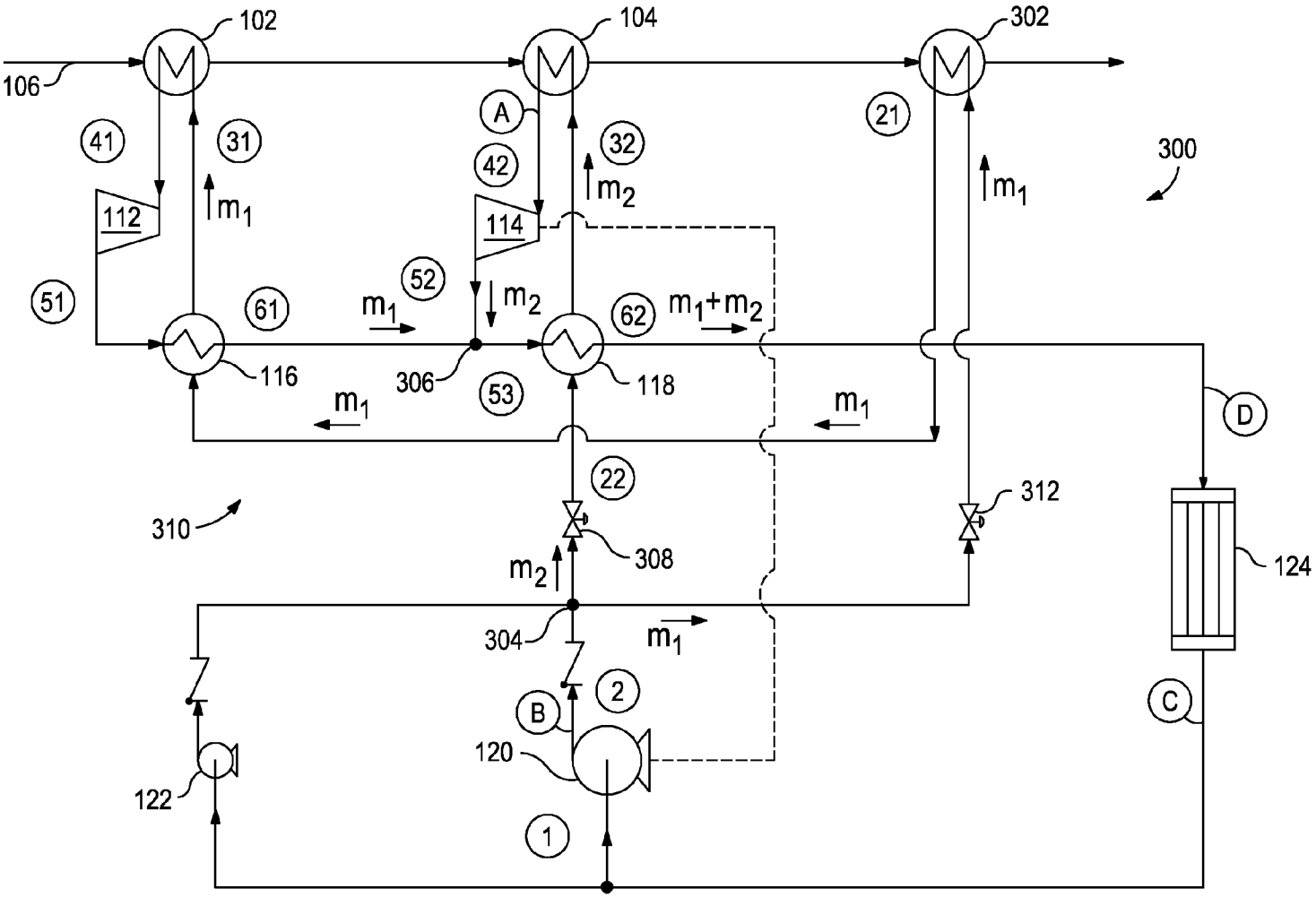
FIG. 3 schematically illustrates another exemplary embodiment of a parallel heat engine cycle, according to one or more embodiments disclosed.

FIG. 3 illustrates another exemplary embodiment of a thermodynamic cycle 300, according to one or more embodiments of the disclosure. The cycle 300 may be similar in some respects to the thermodynamic cycles 100 and/or 200, thereby the cycle 300 may be best understood with reference to FIGS. 1 and 2, where like numerals correspond to like elements and therefore will not be described again in detail. The thermodynamic cycle 300 may include a working fluid circuit 310 utilizing a third heat exchanger 302 in thermal communication with the heat source 106. The third heat exchanger 302 may be a type of heat exchanger similar to the first and second heat exchanger 102, 104, as described above.

The heat exchangers 102, 104, 302 may be arranged in series in thermal communication with the heat source 106 stream, and arranged in parallel in the working fluid circuit 310. The corresponding first and second recuperators 116, 118 are arranged in series on the low temperature side of the circuit 310 with the condenser 124, and in parallel on the high temperature side of the circuit 310. After the working fluid is separated into first and second mass flows $m_1$, $m_2$ at point 304, the third heat exchanger 302 may be configured to receive the first mass flow $m_1$ and transfer heat from the heat source 106 to the first mass flow $m_1$ before reaching the first turbine 112 for expansion. Following expansion in the first turbine 112, the first mass flow $m_1$ is directed through the first recuperator 116 to transfer residual heat to the first mass flow $m_1$ discharged from the third heat exchanger 302.

The second mass flow $m_2$ is directed through the second heat exchanger 104 and subsequently expanded in the second turbine 114. Following the second turbine 114, the second mass flow $m_2$ is re-combined with the first mass flow $m_1$ at point 306 to generate the combined mass flow $m_1+m_2$ which provides residual heat to the second mass flow $m_2$ in the second recuperator 118.

The second turbine 114 again may be used to drive the first or primary pump 120, or it may be driven by other means, as described herein. The second or starter pump 122 may be provided on the low temperature side of the circuit 310 and provide circulate working fluid through a parallel heat exchanger path including the second and third heat exchangers 104, 302. In one exemplary embodiment, the first and third heat exchangers 102, 302 may have essentially zero flow during the startup of the cycle 300. The working fluid circuit 310 may also include a throttle valve 308, such as a pump-drive throttle valve, and a shutoff valve 312 to manage the flow of the working fluid.

Figure 4:
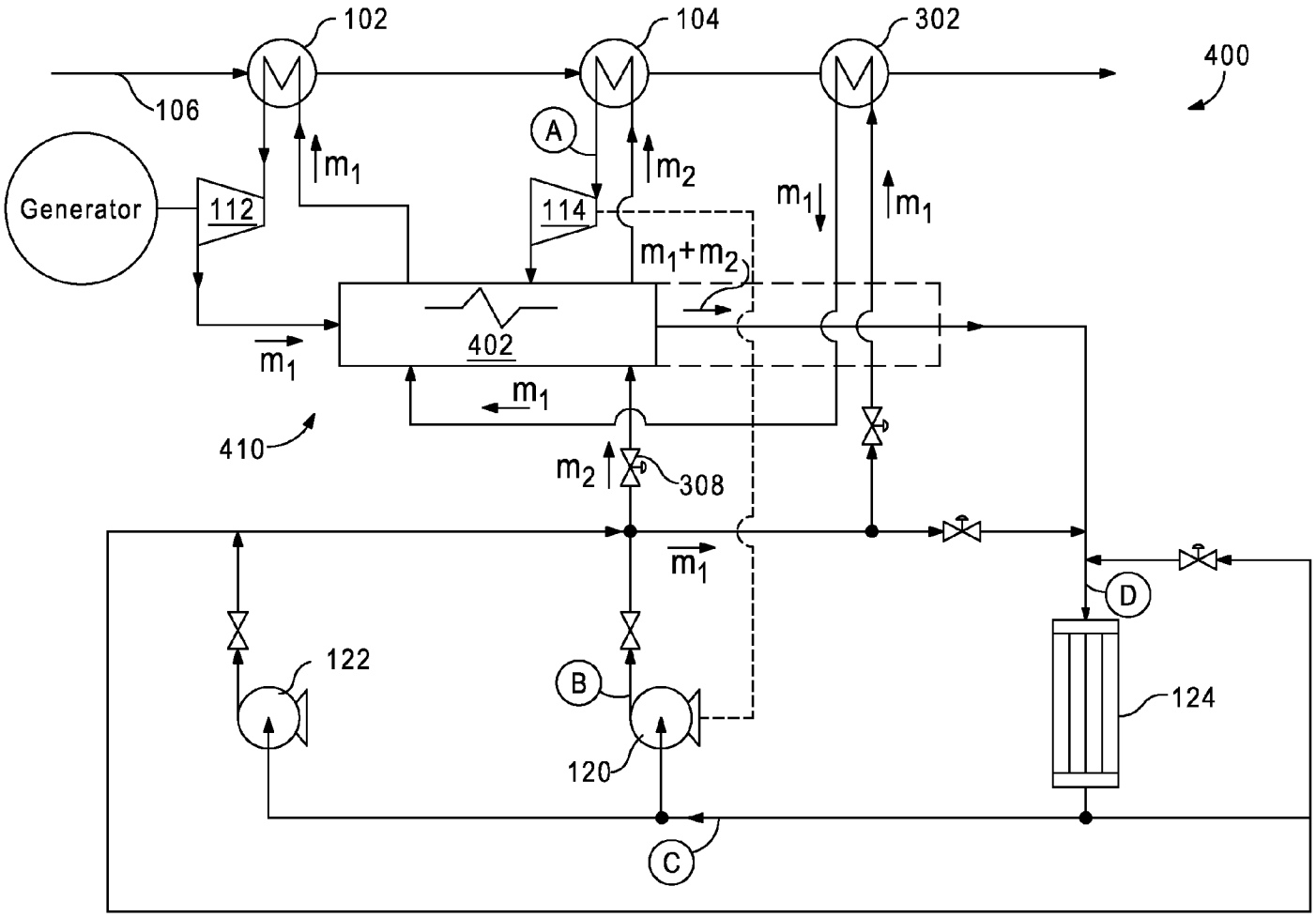
FIG. 4 schematically illustrates another exemplary embodiment of a parallel heat engine cycle, according to one or more embodiments disclosed.

FIG. 4 illustrates another exemplary embodiment of a thermodynamic cycle 400, according to one or more exemplary embodiments disclosed. The cycle 400 may be similar in some respects to the thermodynamic cycles 100, 200, and/or 300, and as such, the cycle 400 may be best understood with reference to FIGS. 1-3, where like numerals correspond to like elements and will not be described again in detail. The thermodynamic cycle 400 may include a working fluid circuit 410 where the first and second recuperators 116, 118 are combined into or otherwise replaced with a single recuperator 402. The recuperator 402 may be of a similar type as the recuperators 116, 118 described herein, or may be another type of recuperator or heat exchanger known to those skilled in the art.

As illustrated, the recuperator 402 may be configured to transfer heat to the first mass flow $m_1$ as it enters the first heat exchanger 102 and receive heat from the first mass flow $m_1$ as it exits the first turbine 112. The recuperator 402 may also transfer heat to the second mass flow $m_2$ as it enters the second heat exchanger 104 and receive heat from the second mass flow $m_2$ as it exits the second turbine 114. The combined mass flow $m_1+m_2$ flows out of the recuperator 402 and to the condenser 124.

In other exemplary embodiments, the recuperator 402 may be enlarged, as indicated by the dashed extension lines illustrated in FIG. 4, or otherwise adapted to receive the first mass flow $m_1$ entering and exiting the third heat exchanger 302. Consequently, additional thermal energy may be extracted from the recuperator 402 and directed to the third heat exchanger 302 to increase the temperature of the first mass flow $m_1$.

Figure 5:
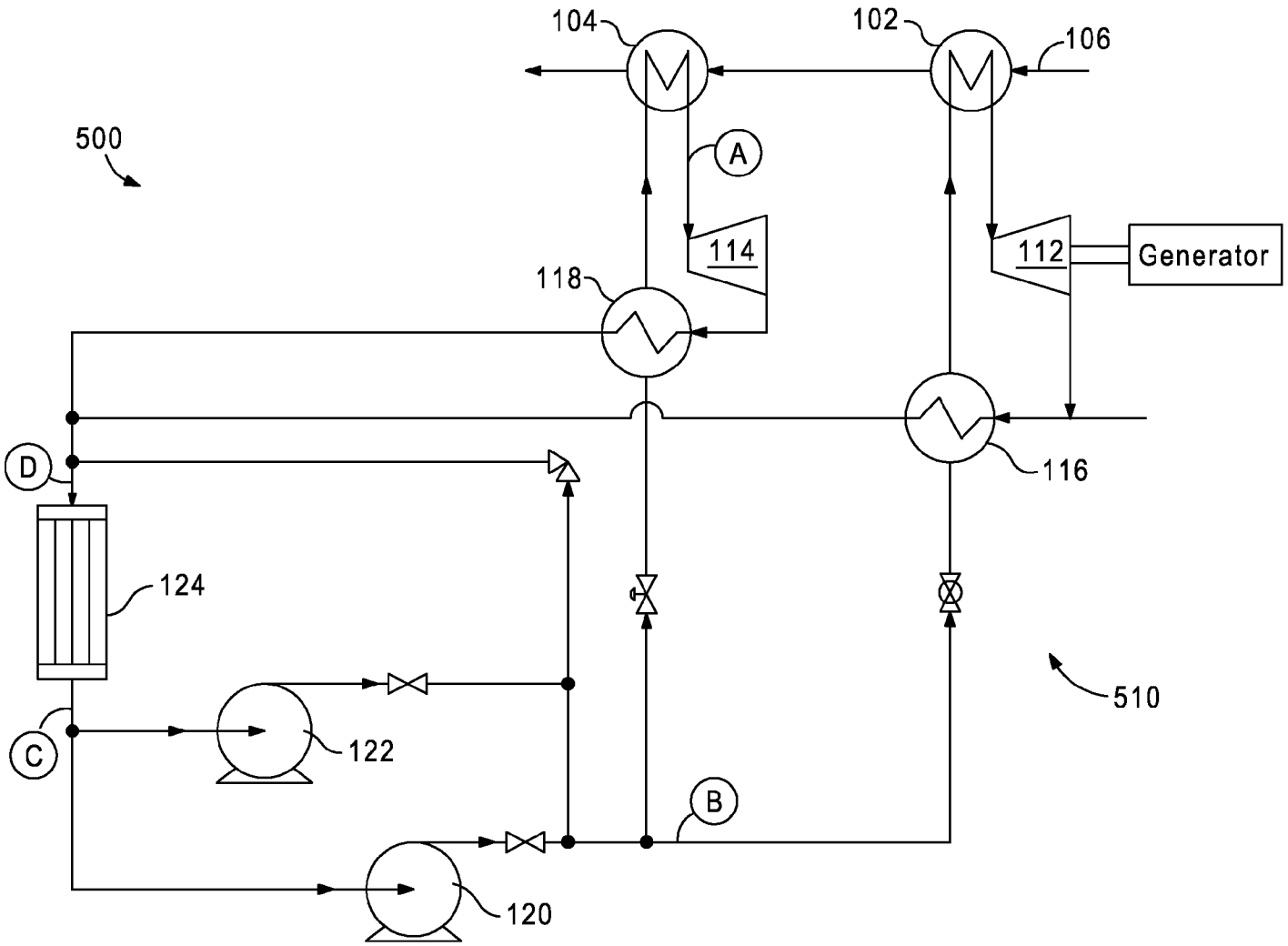
FIG. 5 schematically illustrates another exemplary embodiment of a parallel heat engine cycle, according to one or more embodiments disclosed.

FIG. 5 illustrates another exemplary embodiment of a thermodynamic cycle 500 according to the disclosure. The cycle 500 may be similar in some respects to the thermodynamic cycle 100, and as such, may be best understood with reference to FIG. 1 above, where like numerals correspond to like elements that will not be described again. The thermodynamic cycle 500 may have a working fluid circuit 510 substantially similar to the working fluid circuit 110 of FIG. 1 but with a different arrangement of the first and second pumps 120, 122. As illustrated in FIG. 1, each of the parallel cycles has one independent pump (pump 120 for the high temperature cycle and pump 122 for the low temperature cycle, respectively) to supply the working fluid flow during normal operation. In contrast, the thermodynamic cycle 500 in FIG. 5 uses the main pump 120, which may be driven by the second turbine 114, to provide working fluid flows for both parallel cycles. The starter pump 122 in FIG. 5 only operates during the startup process of the heat engine, therefore no motor-driven pump is required during normal operation.

Figure 6:
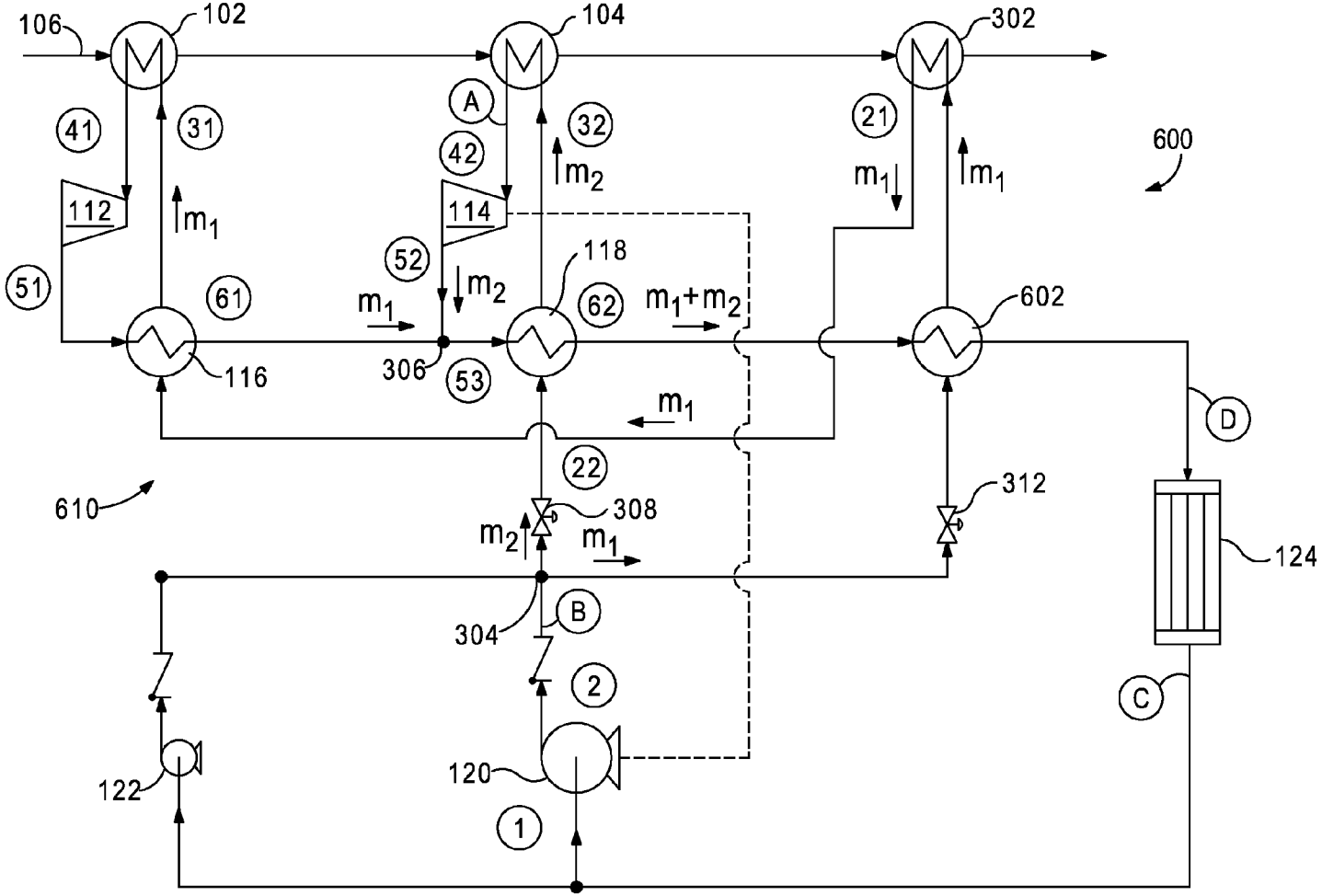
FIG. 6 schematically illustrates another exemplary embodiment of a parallel heat engine cycle, according to one or more embodiments disclosed.

FIG. 6 illustrates another exemplary embodiment of a thermodynamic cycle 600 according to the disclosure. The cycle 600 may be similar in some respects to the thermodynamic cycle 300, and as such, may be best understood with reference to FIG. 3 above, where like numerals correspond to like elements and will not be described again in detail. The thermodynamic cycle 600 may have a working fluid circuit 610 substantially similar to the working fluid circuit 310 of FIG. 3 but with the addition of a third recuperator 602 which extracts additional thermal energy from the combined mass flow $m_1+m_2$ discharged from the second recuperator 118. Accordingly, the temperature of the first mass flow $m_1$ entering the third heat exchanger 302 may be increased prior to receiving residual heat transferred from the heat source 106.

As illustrated, the recuperators 116, 118, 602 may operate as separate heat exchanging devices. In other exemplary embodiments, however, the recuperators 116, 118, 602 may be combined into a single recuperator, similar to the recuperator 406 described above in reference to FIG. 4.

As illustrated by each exemplary thermodynamic cycle 100-600 described herein (meaning cycles 100, 200, 300, 400, 500, and 600), the parallel heat exchanging cycle and arrangement incorporated into each working fluid circuit 110-610 (meaning circuits 110, 210, 310, 410, 510, and 610) enables more power generation from a given heat source 106 by raising the power turbine inlet temperature to levels unattainable in a single cycle, thereby resulting in higher thermal efficiency for each exemplary cycle 100-600. The addition of lower temperature heat exchanging cycles via the second and third heat exchangers 104, 302 enables recovery of a higher fraction of available energy from the heat source 106. Moreover, the pressure ratios for each individual heat exchanging cycle can be optimized for additional improvement in thermal efficiency.

Other variations which may be implemented in any of the disclosed exemplary embodiments include, without limitation, the use of two-stage or multiple-stage pumps 120, 122 to optimize the inlet pressures for the turbines 112, 114 for any particular corresponding inlet temperature of either turbine 112, 114. In other exemplary embodiments, the turbines 112, 114 may be coupled together such as by the use of additional turbine stages in parallel on a shared power turbine shaft. Other variations contemplated herein are, but not limited to, the use of additional turbine stages in parallel on a turbine-driven pump shaft; coupling of turbines through a gear box; the use of different recuperator arrangements to optimize overall efficiency; and the use of reciprocating expanders and pumps in place of turbomachinery. It is also possible to connect the output of the second turbine 114 with the generator or electricity-producing device being driven by the first turbine 112, or even to integrate the first and second turbines 112, 114 into a single piece of turbomachinery, such as a multiple-stage turbine using separate blades/disks on a common shaft, or as separate stages of a radial turbine driving a bull gear using separate pinions for each radial turbine. Yet other exemplary variations are contemplated where the first and/or second turbines 112, 114 are coupled to the main pump 120 and a motor-generator (not shown) that serves as both a starter motor and a generator.

Each of the described cycles 100-600 may be implemented in a variety of physical embodiments, including but not limited to fixed or integrated installations, or as a self-contained device such as a portable waste heat engine or "skid." The exemplary waste heat engine skid may arrange each working fluid circuit 110-610 and related components, such as turbines 112, 114, recuperators 116, 118, condensers 124, pumps 120, 122, valves, working fluid supply and control systems and mechanical and electronic controls, are consolidated as a single unit. An exemplary waste heat engine skid is described and illustrated in U.S. Ser. No. 12/631,412, entitled "Thermal Energy Conversion Device," filed on Dec. 9, 2009, and published as U.S. Pub. No. 2011-0185729, the contents of which are hereby incorporated by reference to the extent not inconsistent with the present disclosure.

The exemplary embodiments disclosed herein may further include the incorporation and use of a mass management system (MMS) in connection with or integrated into the described thermodynamic cycles 100-600. The MMS may be provided to control the inlet pressure at the first pump 120 by adding and removing mass (i.e., working fluid) from the working fluid circuits 110-610, thereby increasing the efficiency of the cycles 100-600. In one exemplary embodiment, the MMS operates with the cycle 100-600 semi-passively and uses sensors to monitor pressures and temperatures within the high pressure side (from pump 120 outlet to expander 116, 118 inlet) and low pressure side (from expander 112, 114 outlet to pump 120 inlet) of the circuit 110-610. The MMS may also include valves, tank heaters or other equipment to facilitate the movement of the working fluid into and out of the working fluid circuits 110-610 and a mass control tank for storage of working fluid. Exemplary embodiments of the MMS are illustrated and described in U.S. Ser. No. 12/631,412, filed Dec. 4, 2009, and published as U.S. Pub. No. 2011-0185729; U.S. Ser. No. 12/631,400, filed Dec. 4, 2009, and published as U.S. Pub. No. 2011-0061387; and U.S. Ser. No. 12/631,379, filed on Dec. 4, 2009, and issued as U.S. Pat. No. 8,096,128; U.S. Ser. No. 12/880,428, filed on Sep. 13, 2010, and issued as U.S. Pat. No. 8,281,593; and PCT Application No. US2011/29486, filed on Mar. 22, 2011, and published as WO 2011/119650. The contents of each of the foregoing applications are hereby incorporated by reference to the extent not inconsistent with the present disclosure.

Figure 7:
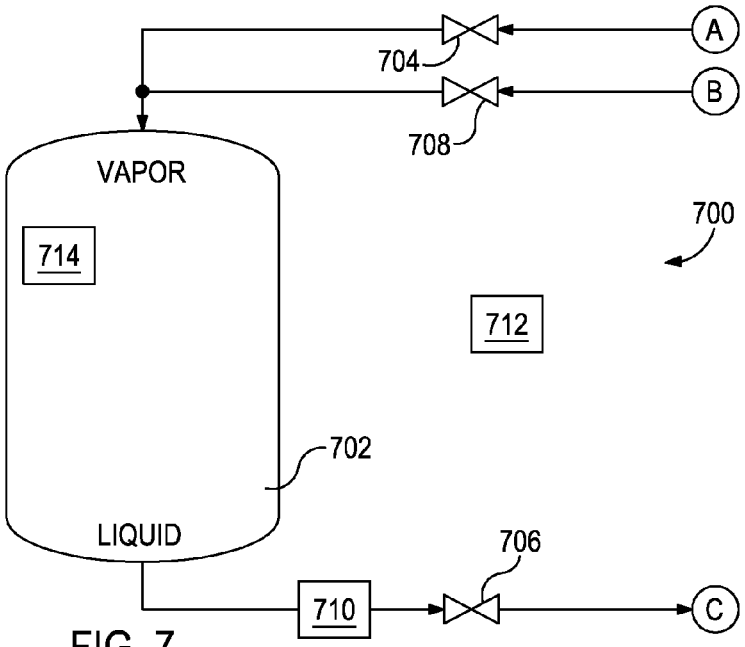
FIG. 7 schematically illustrates an exemplary embodiment of a mass management system (MMS) which can be implemented with a parallel heat engine cycle, according to one or more embodiments disclosed.
Figure 8:
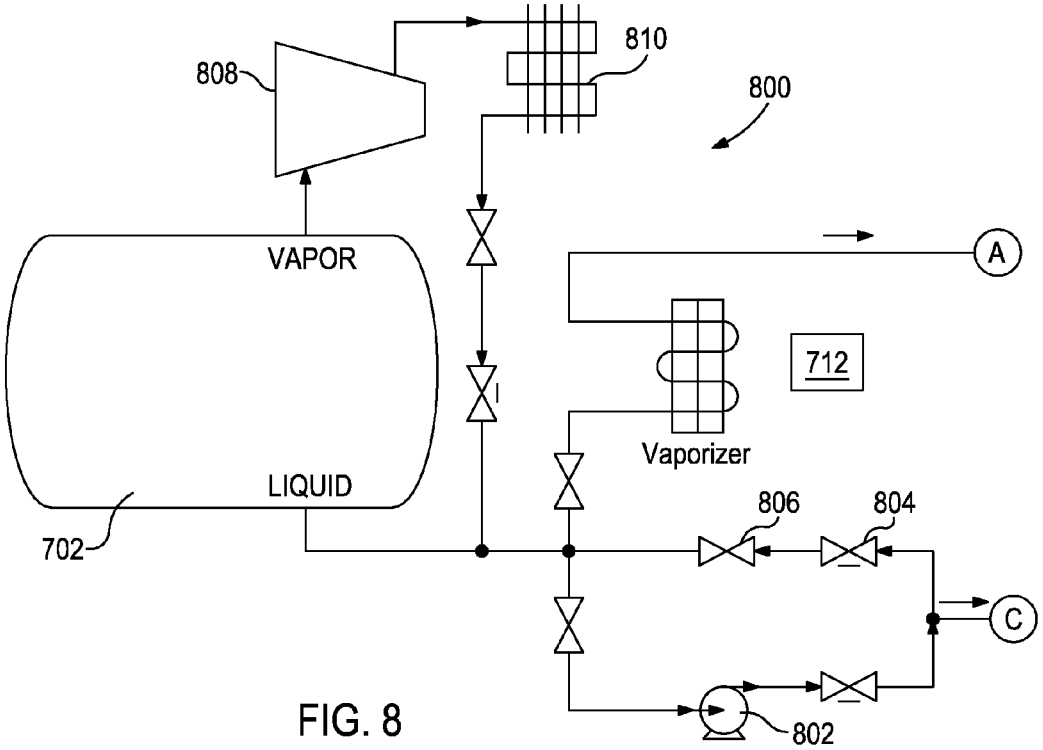
FIG. 8 schematically illustrates another exemplary embodiment of a MMS which can be implemented with a parallel heat engine cycle, according to one or more embodiments disclosed.

Referring now to FIGS. 7 and 8, illustrated are exemplary mass management systems 700 and 800, respectively, which may be used in conjunction with the thermodynamic cycles 100-600 described herein, in one or more exemplary embodiments. System tie-in points A, B, and C as shown in FIGS. 7 and 8 (only points A and C shown in FIG. 8) correspond to the system tie-in points A, B, and C shown in FIGS. 1-6. Accordingly, MMS 700 and 800 may each be fluidly coupled to the thermodynamic cycles 100-600 of FIGS. 1-6 at the corresponding system tie-in points A, B, and C (if applicable). The exemplary MMS 800 stores a working fluid at low (sub-ambient) temperature and therefore low pressure, and the exemplary MMS 700 stores a working fluid at or near ambient temperature. As discussed above, the working fluid may be $CO_2$, but may also be other working fluids without departing from the scope of the disclosure.

In exemplary operation of the MMS 700, a working fluid storage tank 702 is pressurized by tapping working fluid from the working fluid circuit(s) 110-610 through a first valve 704 at tie-in point A. When needed, additional working fluid may be added to the working fluid circuit(s) 110-610 by opening a second valve 706 arranged near the bottom of the storage tank 702 in order to allow the additional working fluid to flow through tie-in point C, arranged upstream from the pump 120 (FIGS. 1-6). Adding working fluid to the circuit(s) 110-610 at tie-in point C may serve to raise the inlet pressure of the first pump 120. To extract fluid from the working fluid circuit(s) 110-610, and thereby decrease the inlet pressure of the first pump 120, a third valve 708 may be opened to permit cool, pressurized fluid to enter the storage tank via tie-in point B. While not necessary in every application, the MMS 700 may also include a transfer pump 710 configured to remove working fluid from the tank 702 and inject it into the working fluid circuit(s) 110-610.

The MMS 800 of FIG. 8 uses only two system tie-ins or interface points A and C. The valve-controlled interface A is not used during the control phase (e.g., the normal operation of the unit), and is provided only to pre-pressurize the working fluid circuit(s) 110-610 with vapor so that the temperature of the circuit(s) 110-610 remains above a minimum threshold during fill. A vaporizer may be included to use ambient heat to convert the liquid-phase working fluid to approximately an ambient temperature vapor-phase of the working fluid. Without the vaporizer, the system could decrease in temperature dramatically during filling. The vaporizer also provides vapor back to the storage tank 702 to make up for the lost volume of liquid that was extracted, and thereby acting as a pressure-builder. In at least one embodiment, the vaporizer can be electrically-heated or heated by a secondary fluid. In operation, when it is desired to increase the suction pressure of the first pump 120 (FIGS. 1-6), working fluid may be selectively added to the working fluid circuit(s) 110-610 by pumping it in with a transfer pump 802 provided at or proximate tie-in C. When it is desired to reduce the suction pressure of the pump 120, working fluid is selectively extracted from the system at interface C and expanded through one or more valves 804 and 806 down to the relatively low storage pressure of the storage tank 702.

Under most conditions, the expanded fluid following the valves 804, 806 will be two-phase (i.e., vapor+liquid). To prevent the pressure in the storage tank 702 from exceeding its normal operating limits, a small vapor compression refrigeration cycle, including a vapor compressor 808 and accompanying condenser 810, may be provided. In other embodiments, the condenser can be used as the vaporizer, where condenser water is used as a heat source instead of a heat sink. The refrigeration cycle may be configured to decrease the temperature of the working fluid and sufficiently condense the vapor to maintain the pressure of the storage tank 702 at its design condition. As will be appreciated, the vapor compression refrigeration cycle may be integrated within MMS 800, or may be a stand-alone vapor compression cycle with an independent refrigerant loop.

The working fluid contained within the storage tank 702 will tend to stratify with the higher density working fluid at the bottom of the tank 702 and the lower density working fluid at the top of the tank 702. The working fluid may be in liquid phase, vapor phase or both, or supercritical; if the working fluid is in both vapor phase and liquid phase, there will be a phase boundary separating one phase of working fluid from the other with the denser working fluid at the bottom of the storage tank 702. In this way, the MMS 700, 800 may be capable of delivering to the circuits 110-610 the densest working fluid within the storage tank 702.

All of the various described controls or changes to the working fluid environment and status throughout the working fluid circuits 110-610, including temperature, pressure, flow direction and rate, and component operation such as pumps 120, 122 and turbines 112, 114, may be monitored and/or controlled by a control system 712, shown generally in FIGS. 7 and 8. Exemplary control systems compatible with the embodiments of this disclosure are described and illustrated in co-pending U.S. patent application Ser. No. 12/880,428, entitled "Heat Engine and Heat to Electricity Systems and Methods with Working Fluid Fill System," filed on Sep. 13, 2010, and incorporated by reference, as indicated above.

In one exemplary embodiment, the control system 712 may include one or more proportional-integral-derivative (PID) controllers as control loop feedback systems. In another exemplary embodiment, the control system 712 may be any microprocessor-based system capable of storing a control program and executing the control program to receive sensor inputs and generate control signals in accordance with a predetermined algorithm or table. For example, the control system 712 may be a microprocessor-based computer running a control software program stored on a computer-readable medium. The software program may be configured to receive sensor inputs from various pressure, temperature, flow rate, etc. sensors positioned throughout the working fluid circuits 110-610 and generate control signals therefrom, wherein the control signals are configured to optimize and/or selectively control the operation of the circuits 110-610.

Each MMS 700, 800 may be communicably coupled to such a control system 712 such that control of the various valves and other equipment described herein is automated or semi-automated and reacts to system performance data obtained via the various sensors located throughout the circuits 110-610, and also reacts to ambient and environmental conditions. That is to say that the control system 712 may be in communication with each of the components of the MMS 700, 800 and be configured to control the operation thereof to accomplish the function of the thermodynamic cycle(s) 100-600 more efficiently. For example, the control system 712 may be in communication (via wires, RF signal, etc.) with each of the valves, pumps, sensors, etc. in the system and configured to control the operation of each of the components in accordance with a control software, algorithm, or other predetermined control mechanism. This may prove advantageous to control temperature and pressure of the working fluid at the inlet of the first pump 120, to actively increase the suction pressure of the first pump 120 by decreasing compressibility of the working fluid. Doing so may avoid damage to the first pump 120 as well as increase the overall pressure ratio of the thermodynamic cycle(s) 100-600, thereby improving the efficiency and power output.

In one or more exemplary embodiments, it may prove advantageous to maintain the suction pressure of the pump 120 above the boiling pressure of the working fluid at the inlet of the pump 120. One method of controlling the pressure of the working fluid in the low-temperature side of the working fluid circuit(s) 110-610 is by controlling the temperature of the working fluid in the storage tank 702 of FIG. 7. This may be accomplished by maintaining the temperature of the storage tank 702 at a higher level than the temperature at the inlet of the pump 120. To accomplish this, the MMS 700 may include the use of a heater and/or a coil 714 within the tank 702. The heater/coil 714 may be configured to add or remove heat from the fluid/vapor within the tank 702. In one exemplary embodiment, the temperature of the storage tank 702 may be controlled using direct electric heat. In other exemplary embodiments, however, the temperature of the storage tank 702 may be controlled using other devices, such as but not limited to, a heat exchanger coil with pump discharge fluid (which is at a higher temperature than at the pump inlet), a heat exchanger coil with spent cooling water from the cooler/condenser (also at a temperature higher than at the pump inlet), or combinations thereof.

Figure 9:
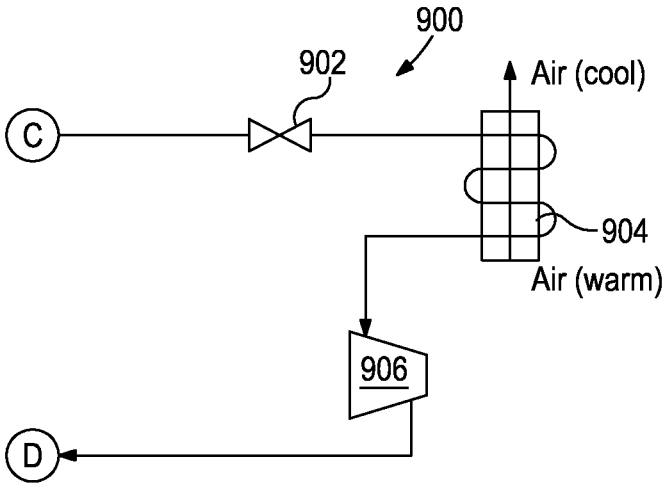
FIGS. 9 and 10 schematically illustrate different system arrangements for inlet chilling of a separate stream of fluid (e.g., air) by utilization of the working fluid which can be used in parallel heat engine cycles disclosed herein.
Figure 10:
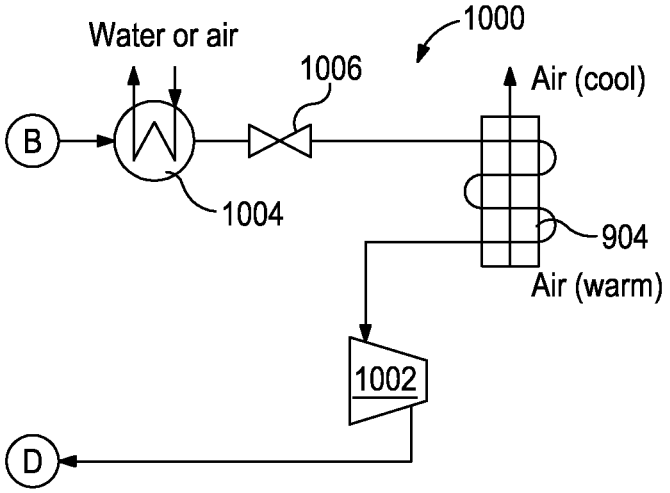

Referring now to FIGS. 9 and 10, chilling systems 900 and 1000, respectively, may also be employed in connection with any of the above-described cycles in order to provide cooling to other areas of an industrial process including, but not limited to, pre-cooling of the inlet air of a gas-turbine or other air-breathing engines, thereby providing for a higher engine power output. System tie-in points B and D or C and D in FIGS. 9 and 10 may correspond to the system tie-in points B, C, and D in FIGS. 1-6. Accordingly, chilling systems 900, 1000 may each be fluidly coupled to one or more of the working fluid circuits 110-610 of FIGS. 1-6 at the corresponding system tie-in points B, C, and/or D (where applicable).

In the chilling system 900 of FIG. 9, a portion of the working fluid may be extracted from the working fluid circuit(s) 110-610 at system tie-in C. The pressure of that portion of fluid is reduced through an expansion device 902, which may be a valve, orifice, or fluid expander such as a turbine or positive displacement expander. This expansion process decreases the temperature of the working fluid. Heat is then added to the working fluid in an evaporator heat exchanger 904, which reduces the temperature of an external process fluid (e.g., air, water, etc.). The working fluid pressure is then re-increased through the use of a compressor 906, after which it is reintroduced to the working fluid circuit(s) 110-610 via system tie-in D.

The compressor 906 may be either motor-driven or turbine-driven off either a dedicated turbine or an additional wheel added to a primary turbine of the system. In other exemplary embodiments, the compressor 906 may be integrated with the main working fluid circuit(s) 110-610. In yet other exemplary embodiments, the compressor 906 may take the form of a fluid ejector, with motive fluid supplied from system tie-in point A, and discharging to system tie-in point D, upstream from the condenser 124 (FIGS. 1-6).

The chilling system 1000 of FIG. 10 may also include a compressor 1002, substantially similar to the compressor 906, described above. The compressor 1002 may take the form of a fluid ejector, with motive fluid supplied from working fluid cycle(s) 110-610 via tie-in point A (not shown, but corresponding to point A in FIGS. 1-6), and discharging to the cycle(s) 110-610 via tie-in point D. In the illustrated exemplary embodiment, the working fluid is extracted from the circuit(s) 110-610 via tie-in point B and pre-cooled by a heat exchanger 1004 prior to being expanded in an expansion device 1006, similar to the expansion device 902 described above. In one exemplary embodiment, the heat exchanger 1004 may include a water-$CO_2$, or air-$CO_2$ heat exchanger. As can be appreciated, the addition of the heat exchanger 1004 may provide additional cooling capacity above that which is capable with the chilling system 900 shown in FIG. 9.

The terms "upstream" and "downstream" as used herein are intended to more clearly describe various exemplary embodiments and configurations of the disclosure. For example, "upstream" generally means toward or against the direction of flow of the working fluid during normal operation, and "downstream" generally means with or in the direction of the flow of the working fluid curing normal operation.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A method for converting thermal energy to work, comprising:

circulating a working fluid comprising carbon dioxide with a pump throughout a working fluid circuit;

separating the working fluid into a first mass flow and a second mass flow within the working fluid circuit;

transferring thermal energy in a first heat exchanger from a heat source to the first mass flow, the first heat exchanger being in thermal communication with the heat source;

expanding the first mass flow in a first turbine fluidly coupled to the first heat exchanger via the working fluid circuit;

transferring residual thermal energy in a first recuperator from the first mass flow discharged from the first turbine to the first mass flow directed to the first heat exchanger, the first recuperator being fluidly coupled to the first turbine via the working fluid circuit;

transferring thermal energy in a second heat exchanger from the heat source to the second mass flow, the second heat exchanger being in thermal communication with the heat source;

transferring thermal energy in a third heat exchanger from the heat source to the first mass flow prior to passing through the first heat exchanger, the third heat exchanger being in thermal communication with the heat source and fluidly arranged between the pump and the first heat exchanger via the working fluid circuit;

expanding the second mass flow in a second turbine fluidly coupled to the second heat exchanger; and transferring residual thermal energy in a second recuperator from a combined first and second mass flow to the first mass flow directed to the first heat exchanger, the second recuperator being fluidly coupled to the second turbine via the working fluid circuit.

2. The method of claim 1, further comprising transferring residual thermal energy in the second recuperator from the second mass flow discharged from the second turbine to the second mass flow directed to the second heat exchanger.

3. The method of claim 2, further comprising transferring residual heat in a third recuperator from the combined first and second mass flow discharged from the second recuperator to the first mass flow before the first mass flow is introduced into the third heat exchanger, the third recuperator being fluidly arranged between the pump and the third heat exchanger via the working fluid circuit.

4. A system for converting thermal energy to work, comprising:

a working fluid comprising carbon dioxide;

a working fluid circuit containing the working fluid;

one pump fluidly coupled to the working fluid circuit and configured to circulate the working fluid throughout the working fluid circuit, the working fluid circuit separating the working fluid into a first mass flow and a second mass flow downstream of the one pump, and wherein an inlet of the one pump receives both the first mass flow and the second mass flow;

a first heat exchanger in fluid communication with the one pump via the working fluid circuit and configured to be in thermal communication with a heat source, the first heat exchanger receiving the first mass flow and configured to transfer thermal energy from the heat source to the first mass flow;

a first turbine fluidly coupled to the first heat exchanger via the working fluid circuit and configured to expand the first mass flow;

a first recuperator fluidly coupled to the first turbine via the working fluid circuit and configured to transfer residual thermal energy from the first mass flow discharged from the first turbine to the first mass flow directed to the first heat exchanger;

a second heat exchanger in fluid communication with the one pump via the working fluid circuit and configured to be in thermal communication with the heat source, the second heat exchanger receiving the second mass flow and configured to transfer thermal energy from the heat source to the second mass flow;

a second turbine fluidly coupled to the second heat exchanger via the working fluid circuit and configured to expand the second mass flow; and a second recuperator fluidly coupled to the second turbine via the working fluid circuit and configured to transfer residual thermal enemy from a combined first and second mass flow to the first mass flow directed to the first heat exchanger.

5. The system of claim 4, wherein the heat source is a waste heat stream.

6. The system of claim 4, wherein the working fluid is at a supercritical state at the inlet to the one pump.

7. The system of claim 4, wherein the first heat exchanger and the second heat exchanger are fluidly arranged in series with the heat source.

8. The system of claim 4, wherein the first mass flow circulates in parallel with the second mass flow.

9. The system of claim 4, wherein the second recuperator is configured to transfer residual thermal energy from the second mass flow discharged from the second turbine to the second mass flow directed to the second heat exchanger.

10. The system of claim 9, wherein the first recuperator and the second recuperator are fluidly arranged in parallel on a low temperature side of the working fluid circuit, and the first recuperator and the second recuperator are fluidly arranged in parallel on a high temperature side of the working fluid circuit.

11. The system of claim 4, wherein an inlet pressure at the first turbine is substantially equal to an inlet pressure at the second turbine.

12. The system of claim 11, wherein a discharge pressure at the first turbine is different than a discharge pressure at the second turbine.

13. The system of claim 4, further comprising a mass management system being operatively connected to the working fluid circuit via at least one tie-in point and including a working fluid storage tank, wherein the mass management system is configured to transfer working fluid between the working fluid circuit and the working fluid storage tank.

14. A system for converting thermal energy to work, comprising:

a working fluid comprising carbon dioxide;

a working fluid circuit containing the working fluid;

a pump fluidly coupled to the working fluid circuit and configured to circulate the working fluid throughout the working fluid circuit, the working fluid circuit separating the working fluid into a first mass flow and a second mass flow downstream of the pump;

a first heat exchanger in fluid communication with the pump via the working fluid circuit and configured to be in thermal communication with a heat source, the first heat exchanger receiving the first mass flow and configured to transfer thermal energy from the heat source to the first mass flow;

a first turbine fluidly coupled to the first heat exchanger via the working fluid circuit and configured to expand the first mass flow;

a first recuperator fluidly coupled to the first turbine via the working fluid circuit and configured to transfer residual thermal energy from the first mass flow discharged from the first turbine to the first mass flow directed to the first heat exchanger;

a second heat exchanger in fluid communication with the pump via the working fluid circuit and configured to be in thermal communication with the heat source, the second heat exchanger being configured to receive the second mass flow and transfer thermal energy from the heat source to the second mass flow;

a second turbine fluidly coupled to the second heat exchanger via the working fluid circuit and configured to expand the second mass flow, the second mass flow being discharged from the second turbine and re-combined with the first mass flow to generate a combined mass flow;

a second recuperator fluidly coupled to the second turbine via the working fluid circuit and configured to transfer residual thermal energy from the combined mass flow to the second mass flow directed to the second heat exchanger; and a third heat exchanger configured to be in thermal communication with the heat source and fluidly arranged between the pump and the first heat exchanger via the working fluid circuit, the third heat exchanger being configured to receive and transfer thermal energy to the first mass flow upstream of the first heat exchanger, and wherein the first heat exchanger, the second heat exchanger, and the third heat exchanger are fluidly arranged in series in the heat source.

15. The system of claim 14, wherein the heat source is a waste heat stream.

16. The system of claim 14, wherein the working fluid is at a supercritical state at an inlet to the pump.

17. The system of claim 14, wherein the first mass flow circulates in parallel with the second mass flow.

18. The system of claim 14, wherein the first and second recuperators form a single recuperator component.

19. The system of claim 14, wherein the first recuperator and the second recuperator are fluidly arranged in series within a low temperature side of the working fluid circuit, and the first recuperator and the second recuperator are fluidly arranged in parallel within a high temperature side of the working fluid circuit.

20. The system of claim 14, further comprising a third recuperator fluidly arranged between the pump and the third heat exchanger via the working fluid circuit.

21. The system of claim 20, wherein the third recuperator is configured to transfer residual heat from the combined mass flow discharged from the second recuperator to the first mass flow before the first mass flow is introduced into the third heat exchanger.

22. The system of claim 21, wherein the first recuperator, the second recuperator, and the third recuperator are fluidly arranged in series within a low temperature side of the working fluid circuit.

23. The system of claim 20, wherein the first recuperator, the second recuperator, and the third recuperator form a single recuperator component.

24. The system of claim 23, wherein the single recuperator component is configured to receive the first mass flow discharged from the third heat exchanger and configured to transfer additional residual thermal energy from the combined mass flow to the first mass flow prior to the first mass flow passing through the first heat exchanger.

25. The system of claim 14, wherein an inlet pressure at the first turbine is substantially equal to an inlet pressure at the second turbine.

26. The system of claim 25, wherein a discharge pressure at the first turbine is different than a discharge pressure at the second turbine.

* * * * *